US010297415B2

(12) United States Patent
M et al.

(10) Patent No.: US 10,297,415 B2
(45) Date of Patent: May 21, 2019

(54) DEEP CHANNEL CATHODE ASSEMBLY

(71) Applicant: GENERAL ELECTRIC COMPANY, Schenectady, NY (US)

(72) Inventors: Anija M, Bangalore (IN); Sergio Lemaitre, Milwaukee, WI (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 337 days.

(21) Appl. No.: 15/168,925

(22) Filed: May 31, 2016

(65) Prior Publication Data

US 2016/0358739 A1 Dec. 8, 2016

(30) Foreign Application Priority Data

Jun. 5, 2015 (IN) ..... 2823/CHE/2015

(51) Int. Cl.
*H01J 35/06* (2006.01)
*H01J 35/08* (2006.01)

(52) U.S. Cl.
CPC ..... *H01J 35/06* (2013.01); *H01J 2235/068* (2013.01)

(58) Field of Classification Search
CPC ..... H01J 35/06; H01J 35/14; H01J 2235/068; H01J 9/04
See application file for complete search history.

(56) References Cited

U.S. PATENT DOCUMENTS 5,303,281 A * 4/1994 Koller ..... H01J 35/06 378/113
5,623,530 A * 4/1997 Lu ..... H01J 35/06 378/136
5,844,963 A * 12/1998 Koller ..... H01J 35/06 378/136

* cited by examiner

*Primary Examiner* — Don K Wong

(57) ABSTRACT

An improved cathode assembly is disclosed. The improved cathode assembly provides a deep channel for holding filament that enables generation of small focal spots, but is not limited in achieving larger focal spot sizes. The cathode assembly includes at least one deep channel and a filament arranged in a deep channel. The deep channel is configured in a cathode cup surface of the cathode assembly. The filament is arranged in the deep channel for enabling emission of electron beams from the cathode assembly.

10 Claims, 3 Drawing Sheets

DEEP CHANNEL CATHODE ASSEMBLY

FIELD OF THE INVENTION

The subject matter disclosed herein relates to X-ray tubes used in medical imaging. More specifically it relates to a cathode assembly for X-ray tubes for generating x-ray energy for medical imaging.

BACKGROUND OF THE INVENTION

An x-ray source is often used is medical imaging systems such as but not limited to, computed tomography, fluoroscopy and mammography systems. The x-ray source typically includes an evacuated vessel known as a frame comprising a cathode and an anode. X-rays are produced by applying a high voltage across an anode and a cathode, and accelerating electrons from the cathode towards a focal spot on the anode.

Cathode assemblies for such x-ray sources typically include a cathode cup and a plurality of current carrying filaments. The filament leads extend through the cup via the filament feed-through assembly, which typically comprises an electrical insulator and a metallic sleeve used for securing the leads at the desired location. The filaments are energized so that electrons accelerate towards the anode to form focal spots. Current cathode cups have shallow channels where the filaments are placed. Further in the absence of external magnetic fields or any biasing electric fields, focal spot size is mainly dependent on filament coil diameter and cathode cup geometry. Therefore it is not easy to achieve focal spot size below 0.3 nominal. The focal spot size is also very sensitive to filament set height which affects the manufacturing cost and degrades the yield of the manufacturing process. Filament set height is the height from the cathode cup channel surface to the tip of the filament positioned in the cathode cup. Further the focal spot size will be also dependent on a radius of the filament channel edge or chamfer. Any change in the radius can lead to a more costly cathode production and/or focal spot size failures during operation. Present methodologies of producing small focal spots require presence of external magnetic or biasing electric fields and/or variation in the filament coil diameter which affects the manufacturing cost.

Accordingly, a need exists for an improved system for achieving smaller focal spot size in an X-ray tube in an efficient manner.

SUMMARY OF THE INVENTION

The object of the invention is to provide an improved cathode assembly for X-ray tubes for generating x-ray energy for medical imaging, which overcomes one or more drawbacks of the prior art. More specifically the system provides a cathode assembly that has the capability of forming small focal spots. This is achieved by the improved cathode assembly having one or more deep channels with filaments having the capability of generating small focal spots as defined in the independent claim.

One advantage with the disclosed improved cathode assembly is that it provides a deep channel for holding filament that enables generation of small focal spots. The cathode assembly includes at least one deep channel and a filament arranged in each deep channel. The deep channel is configured in a cathode cup surface of the cathode assembly. The filament is arranged in the deep channels for enabling emission of electron beams from the cathode assembly.

In another embodiment, an x-ray tube comprises a cathode assembly and an anode assembly. The cathode assembly comprises one or more deep channels, wherein a deep channel is configured in a cathode cup surface of the cathode assembly; and a filament arranged in each deep channel for enabling emission of electron beams from the cathode assembly. The anode assembly converts the electrons to X-ray energy.

A more complete understanding of the present invention, as well as further features and advantages thereof, will be obtained by reference to the following detailed description and drawings.

DETAILED DESCRIPTION OF THE INVENTION

In the following detailed description, reference is made to the accompanying drawings that form a part hereof, and in which is shown by way of illustration specific embodiments that may be practiced. These embodiments are described in sufficient detail to enable those skilled in the art to practice the embodiments, and it is to be understood that other embodiments may be utilized and that logical, mechanical and other changes may be made without departing from the scope of the embodiments. The following detailed description is, therefore, not to be taken as limiting the scope of the invention.

As discussed in detail below, embodiments of an improved cathode assembly is disclosed. The improved cathode assembly provides a deep channel for holding filament that enables generation of small focal spots. The cathode assembly includes at least one deep channel and a filament arranged in a deep channel. The deep channel is configured in a cathode cup surface of the cathode assembly. The filament is arranged in the deep channel for enabling emission of electron beams from the cathode assembly.

Figure 1:
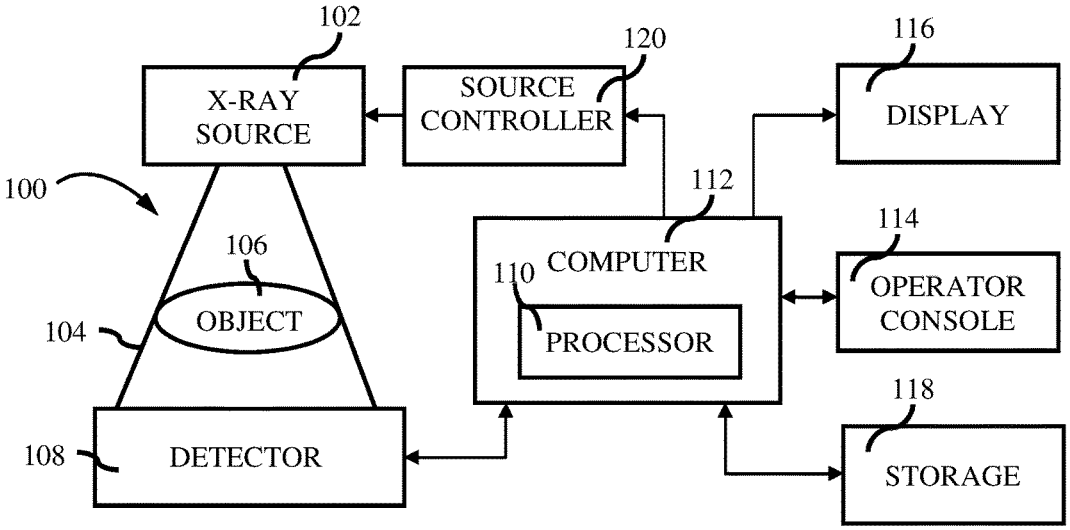
FIG. 1 is a block diagram of an embodiment of an imaging system designed both to acquire original image data and to process the image data for display and/or analysis in accordance with an embodiment of the invention.

FIG. 1 is a block diagram of an embodiment of an imaging system 100 designed both to acquire original image data and to process the image data for display and/or analysis in accordance with an embodiment of the invention. It will be appreciated by those skilled in the art that the invention is applicable to numerous medical imaging systems implementing an x-ray tube, such as x-ray, mammography systems. Other imaging systems such as computed tomography systems and digital/analog radiography systems, which acquire image three dimensional data for a volume, also benefit from an embodiment of the invention. The following discussion of x-ray system 100 is merely an example of one such implementation and is not intended to be limiting in terms of modality.

As shown in FIG. 1, x-ray system 100 includes an x-ray source 102 configured to project a beam of x-rays 104 through an object 106. The object 106 may include a human subject, pieces of baggage, or other objects desired to be scanned. The x-ray source 102 may be a conventional x-ray tube producing x-rays having a spectrum of energies that range, typically, from 30 keV to 200 keV. The x-rays pass through object 106 and, after being attenuated by the object 106, impinge upon a detector array 108. Each detector in detector array 108 produces an electrical signal that represents the intensity of an impinging x-ray beam, and hence the attenuated beam, as it passes through the object 106. In one embodiment, the detector array 108 is a scintillation based detector, however, it is also envisioned that direct-conversion type detectors (e.g., CZT detectors, etc.) may also be implemented.

A processor 110 receives the electrical signals from the detector array 108 and generates an image corresponding to the object 106 being scanned. A computer 112 communicates with processor 110 to enable an operator, using operator console 114, to control the scanning parameters and to view the generated image. That is, the operator console 114 includes some form of operator interface, such as a keyboard, mouse, voice activated controller, or any other suitable input apparatus that allows an operator to control the x-ray system 100 and view the reconstructed image or other data from the computer 112 on a display unit 116. Additionally, the console 114 allows an operator to store the generated image in a storage device 118 which may include hard drives, floppy discs, compact discs, etc. The operator may also use console 114 to provide commands and instructions to computer 112 for controlling a source controller 120 that provides power and timing signals to the x-ray source 102.

Figure 2:
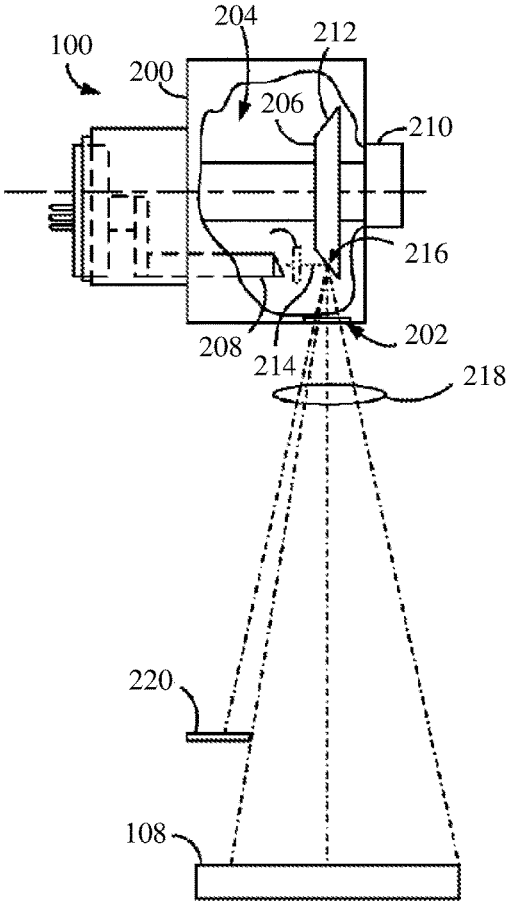
FIG. 2 illustrates a schematic diagram of a portion of imaging system of FIG. 1 according to an embodiment of the invention.

FIG. 2 illustrates a schematic diagram of a portion of imaging system 100 of FIG. 1 according to an embodiment of the invention. The x-ray source 102 includes a vacuum chamber or frame 200 having a radiation emission passage 202 formed therein. The frame 200 encloses a vacuum 204 and houses an anode 206, a cathode 208, and a rotor 210. The anode 206 includes a target track 212.

A voltage differential or potential such as, for example, 60,000 volts or more, between the cathode 208 and the anode 206 accelerates an electron beam 214 from the cathode 208 to a focal spot 216 on the anode 206. A stream of x-rays or x-ray beam 220 from the target track 212 is produced when high-speed electrons from the electron beam 214 are decelerated. The x-ray beam 218 emits through radiation emission passage 202 and fan out toward the detector array 108. In an embodiment the path of the electron beam 214 may be controlled by a geometry of the deep channel by the electrostatic potential gradient between the cathode 208 and the anode 206. In another embodiment the path of the electron beam 214 may additionally be controlled by one or more electrostatic potentials applied to the deep channel walls. Generally, a cathode having one or more deep channels can be operated with external magnetic or biasing electric fields to further enhance the control of the electron beam.

As shown in FIG. 2, an x-ray opaque material 220 may be positioned in the path of the x-ray beam 218 for determining characteristics of the focal spot 216 according to embodiments of the invention. The material 220 may be, for example, a tungsten edge or another suitable material for blocking x-rays and may be mounted to a bar (not shown) and placed within a collimator (not shown). In one embodiment, the tungsten edge is 0.1 mm thick; however, other sizes are contemplated. As will be described below, the x-ray projection of the tungsten edge upon a detector enables measurement of an edge-response function from which a size and position of the focal spot can be determined.

Figure 3:
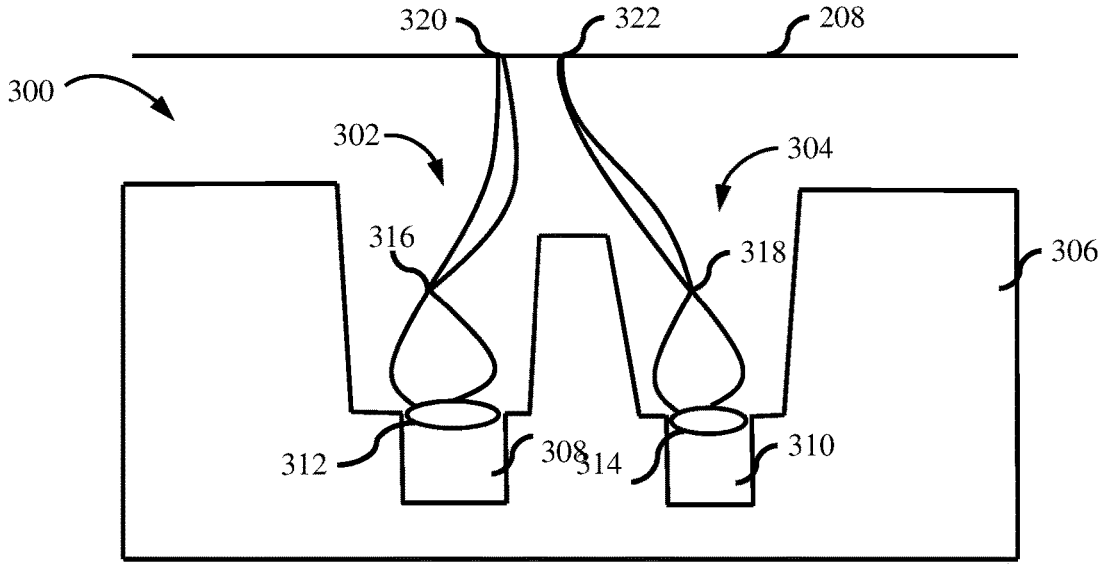
FIG. 3 illustrates a cross-sectional view of a cathode assembly according to an exemplary embodiment.

FIG. 3 illustrates a schematic diagram of a cathode assembly 300 according to an exemplary embodiment. A cross-section of the cathode assembly 300 is shown in FIG. 3. The cathode assembly 300 includes one or more deep channels such as a deep channel 302 and a deep channel 304. These deep channels are configured or arranged in a cathode cup surface 306. The cathode cup surface 306 may have different shapes and arrangement to accommodate the deep channels. For instance the deep channels 302 and 304 may be formed by cutting deep into the cathode cup surface 306. The deep channel also has a smaller channel which may be cut into the cathode cup surface 306. The deep channel 302 and the deep channel 304 include a smaller channel 308 and a smaller channel 310 respectively. Filaments are arranged in these smaller channels. A filament 312 is arranged within the deep channel 302 and another filament 314 is arranged within the deep channel 304. As illustrated in FIG. 3 the filament 312 is placed in the smaller channel 308 and the filament 314 is placed in the smaller channel 310. A portion of these filaments are exposed out from the smaller channels when placed and the remaining portion of the filaments is present within the smaller channels. A height measured from the top of the filament to the bottom of the smaller channel is known as filament set height. Thus filament set height can vary based on the portion of the filament exposed out from the smaller channel. During operation the current is supplied to the filaments 312 and 314 so that thermionic emission creates a cloud of electrons around the filament, which will in turn be extracted as x-ray tube current for the generation of x-ray from the anode, upon the application of high electric potential across the cathode-anode gap. The filaments 312 and 314 generate electrons that flow towards the anode 208, under the influence of the electric potential difference. If the channel is sufficiently deep, the electron beams from the filaments 312 and 314 cross-over at some point before reaching the anode. Thus the trajectory of the electron beams is controlled in such a way to have the cross-over within the deep channel such as the deep channel 302 and the deep channel 304. For instance the electron beams from the filament 312 cross-over at a point 316 and electron beams from the filament 314 cross-over at a point 318. The electron beams bent to cross-over at these points 316 and 318 due to structure of the deep channels 302 and 304 for instance the depth of these channels. These cross-over points 316 and 318 act as a virtual emitter of electrons. Thus the deep structure of the deep channels 302 and 304 facilitate the electron beams to focus within the channels at cross-over points 316 and 318. The crossing-over of the electron beams results in reducing the size or span of the electron beam. In an embodiment a virtual emitter i.e. the cross-over points 316 and 318 may have a diameter smaller than diameter of the filament.

After crossing-over, the electron beams are once more focused in the region of the deep channel above the cross-over point and travel to reach the anode 208 to form focal spots 320 and 322. The focal spots are the points on the surface of the anode 208 where the electrons travel and impact. The focal spots 320 and 322 are smaller focal spots. The focal spots size may have a size smaller than 0.3 nominal. In an embodiment the focal spot size may vary from 0.1 nominal to 0.3 nominal. However it may be appreciated that the different embodiments described herein is not limited to small focal spots only. With deep channel embodiment a range of focal spots varying from 0.1 nominal to beyond 1.5 nominal can be achieved.

Figure 4:
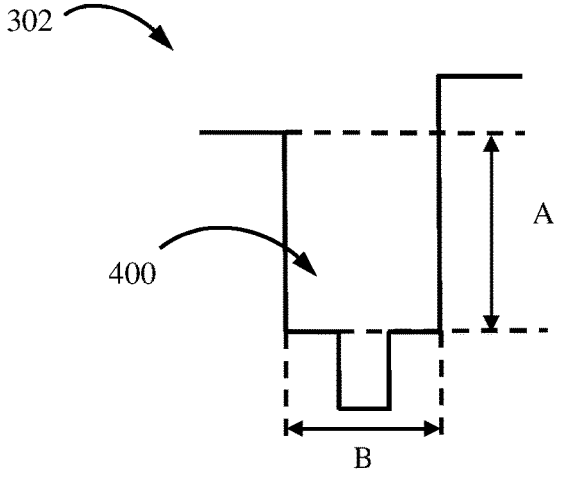
FIG. 4 illustrates a cross-sectional view of the deep channel according to an exemplary embodiment.

FIG. 4 illustrates a cross-sectional view of the deep channel 302 according to an exemplary embodiment. The deep channel 302 as illustrated includes the smaller channel 308. An aspect ratio of the deep channel 302 determines how the electron beam crosses over to form a small focal spot. The aspect ratio is a ratio of the depth of a first channel 400 and the width of the first channel 400. The depth is indicated by 'A' and the width is indicated by 'B'. In an embodiment the aspect ratio of the deep channel 302 may be 1.3. However it may be envisioned that the aspect ratio of the deep channel 302 may be 1.3 or greater without deviating from the scope of this disclosure, however the 1.3 is the minimum aspect ratio that may be needed. In comparison, the aspect ratio of existing cathodes is typically smaller than 1.3. When the aspect ratio is 1.3 the cross over point of the electron beams may be marginally outside of the deep channel 302. Thus cross over point of the electron beams may move outside or inside the deep channel 302 based on the aspect ratio. Further the filament set height can be set in a convenient manner i.e. not stringent in the deep channel 302. The deep channel allows a higher filament set height tolerance and higher filament diameter tolerance for smaller focal spots. Therefore set height may not be a stringent parameter while configuring or manufacturing the cathode assembly or arranging the filament in the deep channel of the cathode assembly. For instance if tolerance of the set height of the filament is approximately +or −50 μm then the focal spot size may only vary approximately by +or −5%. However the shallow channel may have the same variation in the focal spot size when the set height tolerance is only +or −8 μm. The filament channel radius may not be a critical factor when a deep channel is used for placing the filament thereby simplifying the designing and manufacturing of cathode assembly.

Figure 5:
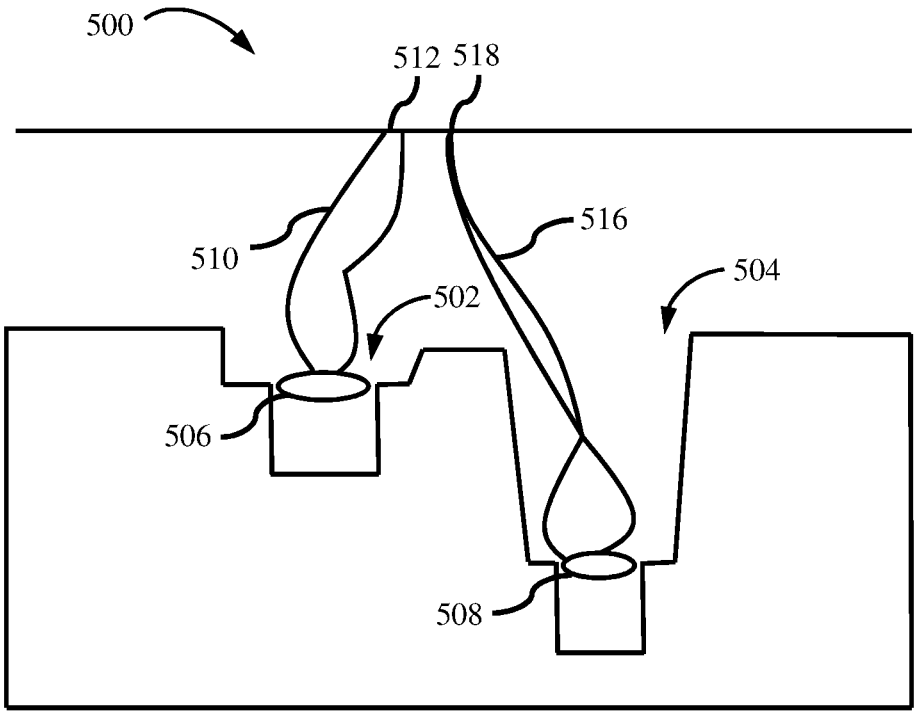
FIG. 5 illustrates a cross-sectional view of a cathode assembly according to another exemplary embodiment.

FIG. 5 illustrates a schematic diagram of a cathode assembly 500 according to another exemplary embodiment. The cathode assembly 500 includes a combination of a shallow channel 502 and a deep channel 504. Filament 506 and filament 508 are arranged in the shallow channel 502 and the deep channel 504 respectively. Once the filament 506 is excited using the electric field an electron beam 510 forms a focal spot 512 at an anode 514. Similarly the filament 508 may be excited so that an electron beam 516 forms a focal spot 518 on the anode 514. The size of the focal spot 512 may be larger than the focal spot 518. The focal spot generated by the deep channel 504 may always be smaller than the focal spots generated using the shallow channel 502.

Figure 6:
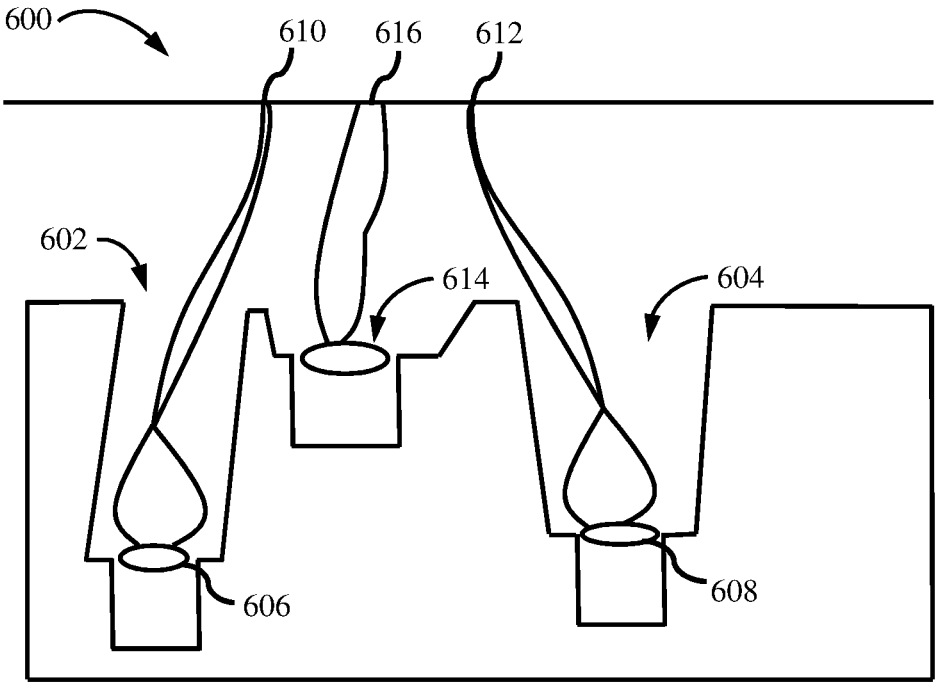
FIG. 6 illustrating a cathode assembly having a combination of two deep channels and a shallow channel according to an exemplary embodiment.

Now turning to FIG. 6 illustrating a cathode assembly 600 having a combination of two deep channels and a shallow channel according to an exemplary embodiment. The two deep channels are a deep channel 602 and a deep channel 604 that includes a filament 606 and a filament 608 respectively. The deep channels 602 and 604 facilitate in formation of a focal spot 610 and a focal spot 612 that are smaller in size. Further a shallow channel 614 facilitates formation of a focal spot 616 having size larger than the focal spot 612. However deep channel embodiment is not limited to small focal spots. Depending on the combination of deep channel aspect ratio and the filament parameters, deep channel focal spot size can also be made larger than that of shallow channel focal spot. There are different combinations of the deep channels and shallow channels possible for a cathode assembly according to different embodiments of the disclosure even though few combinations are explained in conjunction with FIG. 3, FIG. 5 and FIG. 6. Moreover even though the deep channels shown in FIGS. 5 and 6 are shown to have angled orientations, they are merely exemplary and the orientation and structural configuration of these deep channels may be normal to the cathode surface or may have any structural configurations within the scope of this disclosure.

From the foregoing, it will be appreciated that the above disclosed system provides an improved way of generating smaller focal spots, but not limited in attainable focal spot dimensions, at the anode. Usually in a cathode assembly the filaments are placed in a shallow channel and therefore small focal spots not easily formed. However the disclosed system have filaments placed in a deep channel that enables focusing of electrons to a small impact region thereby resulting in generation of smaller focal spots at the anode with much less design and manufacturing demands. Further the size of focal spot is always sensitive to a filament set height, however the deep channels enables the disclosed system to make the focal spot size to be significantly less sensitive of the filament set height. The focal spot size also may not be dependent on the channel radius due to the deep structure of the channel where the filament is placed which contributes to simplicity in the manufacturing process. The size of the filament is also not a factor for achieving a smaller focal spot in the disclosed system hence filament with a larger diameter can be also placed in the deep channel to generate a smaller focal spot. The filament with larger diameter has a longer life and consequently the life of the X-ray tube assembly is also increased.

This written description uses examples to disclose the invention, including the best mode, and also to enable any person skilled in the art to practice the invention, including making and using any computing system or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

We claim:

1. A cathode assembly comprising:

at least one deep channel comprising an upper channel portion and a lower channel portion configured in a cathode cup surface of the cathode assembly, the upper channel portion of the at least one deep channel having a depth (A) and a width (B) where the depth to width ratio (A/B) is at least 1.3; and a filament arranged in the at least one deep channel to emit electron beams from the cathode assembly.

2. The cathode assembly of claim 1, wherein the filament focuses the electrons to form at least one focal spot.

3. The cathode assembly of claim 2, wherein a focal spot of the at least one focal spot is greater than or equal to 0.1 mm nominal.

4. The cathode assembly of claim 1, wherein the at least one deep channel facilitates the electron beams to cross-over within the cathode cup to form at least one small focal spot.

5. The cathode assembly of claim 4, wherein a point of the cross-over of the electron beams has a width smaller than a width of the filament.

6. An X-ray tube comprising:

a cathode assembly comprising:

at least one deep channel comprising an upper channel portion and a lower channel portion configured in a cathode cup surface of the cathode assembly, the upper channel portion of the at least one deep channel having a depth (A) and a width (B) where the depth to width ratio (A/B) is at least 1.3; and a filament arranged in the at least one deep channel to emit of electron beams from the cathode assembly; and an anode assembly to receive the electrons to generate X-ray energy.

7. The X-ray tube of claim 6, wherein the filament focuses the electrons to form at least one small focal spot.

8. The X-ray tube of claim 7, wherein a small focal spot of the at least one small focal spot range is greater than or equal to 0.1 mm nominal.

9. The X-ray tube of claim 6, wherein the at least one deep channel facilitates the electron beams to cross-over within the cathode cup to form at least one small focal spot.

10. The X-ray tube of claim 9, wherein a point of the cross-over of the electron beams has a width smaller than a width of the filament.

* * * * *